United States Patent [19]

Gerritsen

[11] Patent Number: 5,058,323

[45] Date of Patent: Oct. 22, 1991

[54] EXTERIOR JAMB CLADDING AND BRICK MOLD ASSEMBLY

[75] Inventor: John Gerritsen, Wauconda, Ill.

[73] Assignee: Jarrow Products, Inc., Chicago, Ill.

[21] Appl. No.: 580,855

[22] Filed: Sep. 11, 1990

[51] Int. Cl.[5] ..... E06B 1/04; E06B 3/30

[52] U.S. Cl. ..... 49/504; 49/460; 52/211

[58] Field of Search ..... 49/504, 460, 462, 489, 49/505; 52/211, 213, 212

[56] References Cited

U.S. PATENT DOCUMENTS

| | | | |
|---|---|---|---|
| 3,420,003 | 1/1969 | Cline | 52/212 X |
| 3,591,985 | 7/1971 | Coppins | 49/504 |
| 3,975,875 | 8/1976 | Goss, Jr. | 52/211 |
| 4,207,707 | 6/1980 | Holdiman et al. | 49/504 X |
| 4,228,630 | 10/1980 | Englert et al. | 52/211 X |
| 4,430,830 | 2/1984 | Sailor | 49/504 X |
| 4,509,294 | 4/1985 | Boilard | 49/504 |
| 4,573,287 | 3/1986 | Hagemeyer et al. | 49/504 X |
| 4,658,548 | 4/1987 | Gerritsen | 49/489 X |
| 4,761,920 | 8/1988 | Coulson | 52/211 X |
| 4,930,257 | 6/1990 | Windgassen | 49/504 |

*Primary Examiner*—Philip C. Kannan

*Attorney, Agent, or Firm*—Silverman, Cass & Singer, Ltd.

[57] ABSTRACT

A jamb cladding and brick mold assembly for enclosing the exterior surfaces of a jamb surrounding an opening in a building such as a door, garage door or window and providing a maintenance free protective cover for the jamb as well as a decorative molding between the jamb and an exterior surface of a building. The assembly includes a jamb cladding member for enclosing the exposed exterior surfaces of the jamb, where the cladding member has a first end connected to the jamb. A brick mold member is positioned overlying the interface between the jamb and the exterior surface of the building and a first connecting member for connecting the brick mold member to the first end of the cladding member is included so that the brick mold member overlies and conceals the first connecting member and the interface between the cladding member and the brick mold member from the exterior thereof.

25 Claims, 2 Drawing Sheets

Fig. 1
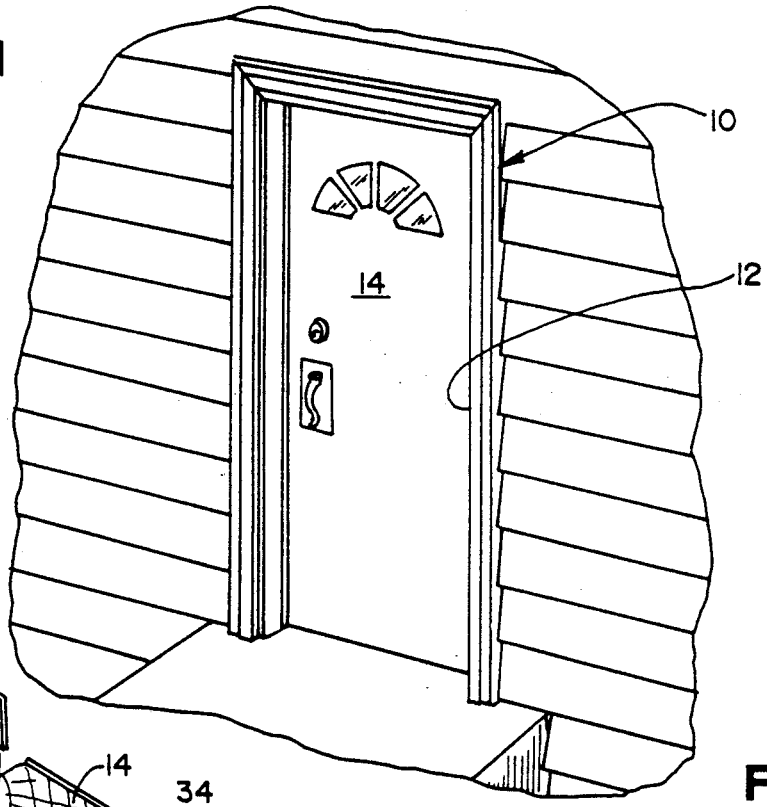
Fig. 1A
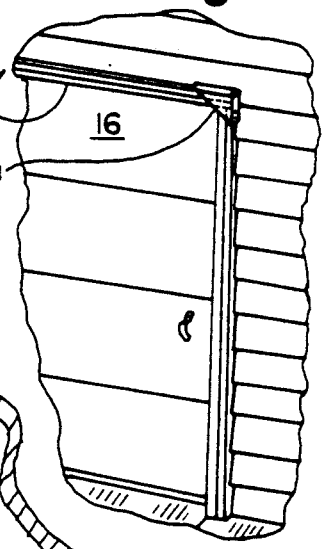
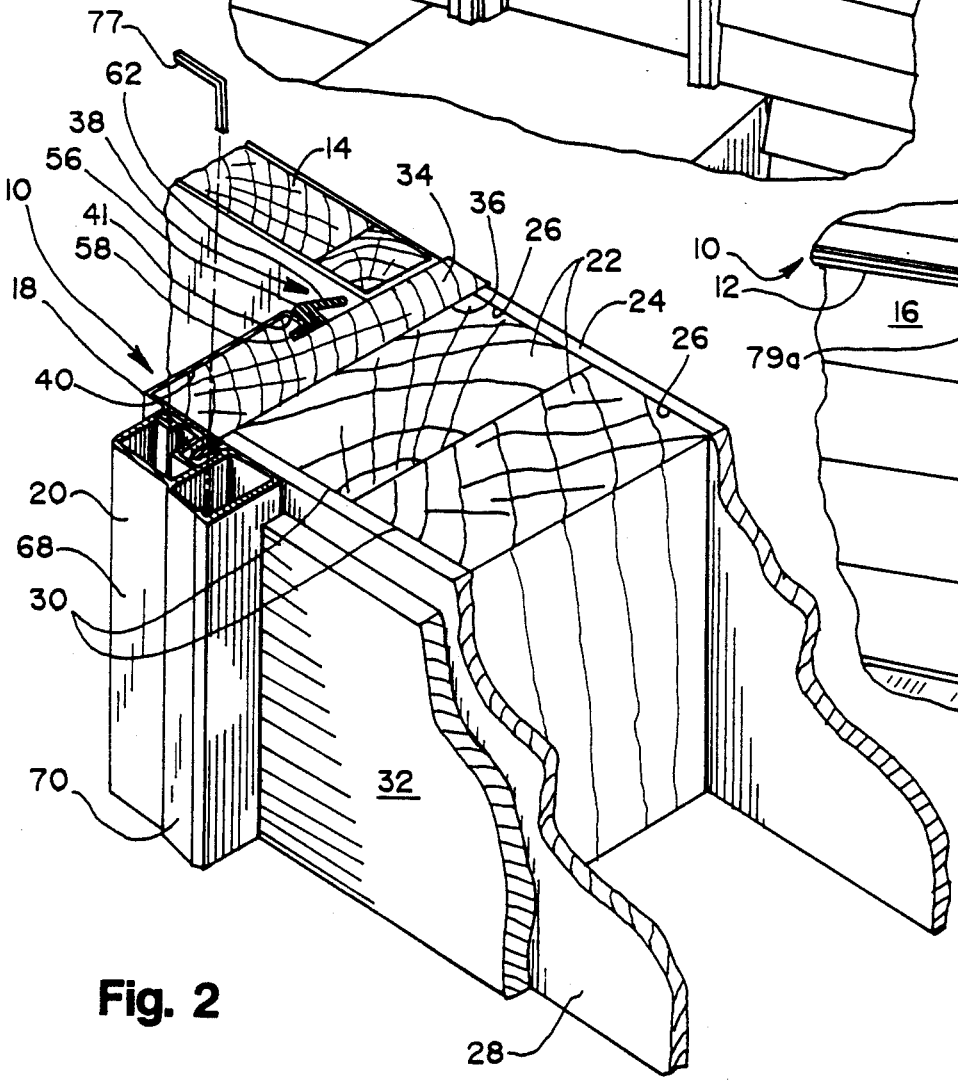
Fig. 2

EXTERIOR JAMB CLADDING AND BRICK MOLD ASSEMBLY

FIELD OF THE INVENTION

The invention relates to a cladding or protective layer for the exterior surfaces of door or window jambs and more particularly, to a novel jamb cladding and combination brick mold assembly for the exterior surface of the jambs. The assembly provides a maintenance free protective cover for the jambs as well as a decorative molding between the jambs and the exterior surface of a building which readily can be assembled to the jamb during or after construction with or without any modifications to the jamb.

BACKGROUND OF THE INVENTION

Openings or embrasures in a building, such as a house, typically are made for mounting a door or window therein. These openings initially are framed by wall studs made of wood or other material. The interior perimetric edges of the wall studs which define the opening then are finished by wooden, metal, plastic or similar jambs secured to the wall studs. These jambs can be of a simple design to provide a generally planar surface facing the interior of the opening or can be cut, formed and/or routed to provide a finished decorative appearance having a specific cross-sectional profile. One or more stops for the door or window also must be provided to ensure proper movement and positioning of the door or window. These stops can be provided by cutting, forming or routing the jamb itself into a desired configuration or by securing a separate strip to the jamb.

Since door or window jambs typically have a significant amount of exterior surface area exposed to the elements, they must be protected, especially jambs made of wood or metal. Normally, these jambs are protected with a coat of paint, stain, varnish or the like which must be removed and reapplied every few years to provide proper protection. Alternatively, a weatherproof cladding or protective layer can be installed over the exposed exterior surfaces of the jamb to provide the desired protection.

Cladding for door or window jambs with which the invention is concerned are known in the art. An example of cladding for a decorative jamb is disclosed in U.S. Pat. No. 3,340,665. Such cladding typically is formed from plastic with specific dimensions to match the detailed cross-sectional profile of the wooden jamb which is out or routed in several areas to provide one or more stops as well as a decorative appearance. The cladding can be adhesively or otherwise bonded to the jamb on site during construction of the building or can be applied at the factory to provide a prefabricated jamb.

U.S. Pat. No. 4,328,644 discloses a plastic clad window and method of manufacture including a prefabricated synthetic plastic shell having a wooden frame bonded therein. The shell, in effect, is a substitute for the exterior decorative jamb described above.

In order to provide an attractive transition between the door or window jamb and the exterior surface of a building, separate molding members, known as brick molds, typically are utilized. Such brick molds can be formed to provide a decorative look and are positioned to overlie the seam or interface between, and are secured to at least one of, the jamb and the exterior building surface. These brick molds typically are utilized to provide a decorative look to the planar jambs, but also can be utilized with the decorative routed jambs as described above.

The exterior jamb cladding and brick mold assembly embodying the invention provides significant advantages over previous jamb cladding members which typically do not include separate molding members. Specifically, the assembly includes a jamb cladding member and separate molding member which readily can be applied either during or after construction, to jambs with or without stops, and with or without any modification of the jamb. The assembly also can be adjustable to fit a variety of jamb dimensions, if desired. The completed assembly has no exposed fasteners and allows for expansion and contraction within the assembly due to changes in temperature. Effective weather stripping also can be provided between the assembly and the entire periphery of the door or window sash. The assembly can be formed in a variety of colors, can be embossed with a wood grain or other pattern, and can be painted if desired.

SUMMARY OF THE INVENTION

The invention provides a jamb cladding and brick mold assembly for enclosing the exterior surfaces of a jamb surrounding an opening in a building such as a door, garage door or window and providing a maintenance free protective cover for the jamb as well as a decorative molding between the jamb and an exterior surface of a building. The assembly includes a jamb cladding member for enclosing the exposed exterior surfaces of the jamb where a first end of the cladding member is connected to the jamb. A brick mold member is positioned overlying the interface between the jamb and the exterior surface of the building. A first connecting member for connecting the brick mold member to the first end of the cladding member also is provided so that the brick mold member overlies and conceals the first connecting member and the interface between the cladding member and the brick mold member from the exterior of the assembly.

The assembly can include a second connecting member for connecting the brick mold member to the cladding member as well as weather stripping between the assembly and the door or window. The assembly also can be adjustable to accommodate different sizes of jambs and can be designed to be assembled without the need for any modification to the existing jamb.

BRIEF DESCRIPTION OF THE DRAWINGS

FIG. 1 illustrates the assembly of the invention utilized with a doorway of a house;

FIG. 1*a* illustrates the assembly of the invention utilized with a garage door;

FIG. 2 is a horizontal cross-sectional perspective view of the assembly of the invention;

DESCRIPTION OF THE PREFERRED EMBODIMENTS

Figure 3:
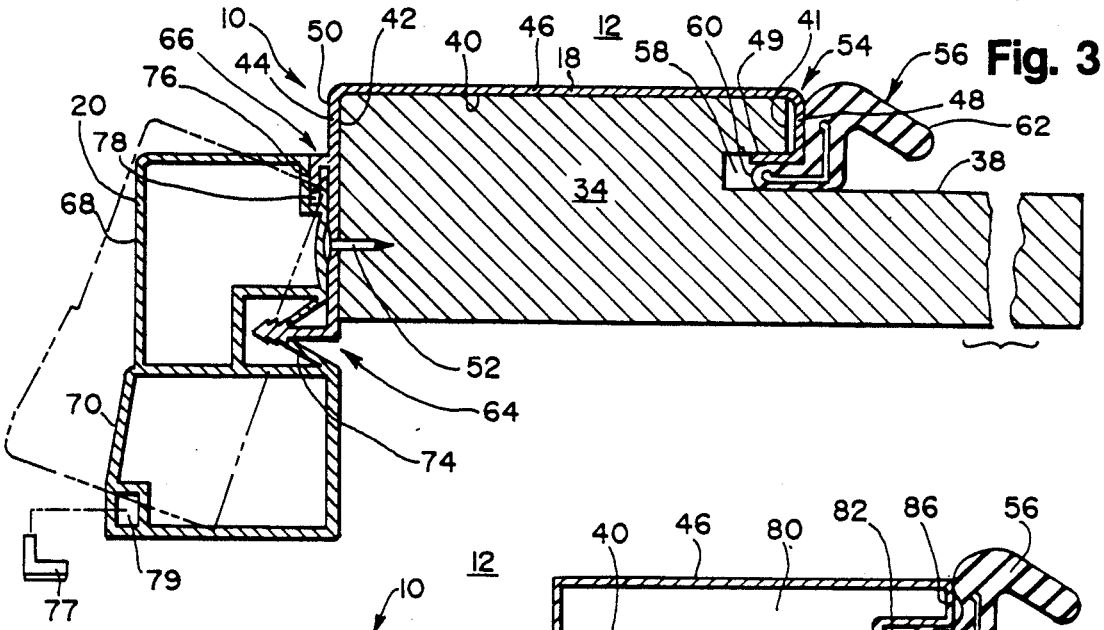
FIG. 3 is a horizontal cross-sectional view of the assembly of the invention of FIG. 2.

Referring to FIGS. 1, 1*a* and 2, a jamb cladding and brick mold assembly embodying the invention is designate generally by the reference numeral 10. The assembly 10 typically is utilized to finish the doorway opening 12 in a home which is formed to mount a door therein, such as a front or back door 14, as illustrated in FIG. 1, or a garage door 16, as illustrated in FIG. 1*a*. It is to be understood, however, that the assembly 10 can be utilized to finish any type of opening such as a window, skylight or the like (not illustrated.)

As FIGS. 2 and 3 illustrate, the assembly 10 preferably includes a jamb cladding member 18 and a brick mold member 20. The jamb cladding member 18 and brick mold member 20 preferably are constructed from vinyl or plastic to a desired length which is cut on site to a specific length to fit the opening 12. Alternatively, the jamb cladding member 18 and brick mold member 20 can be precut and/or metered at the factory to desired specifications, ready for assembly. It is to be noted, however, that the particular shape, length and material of the jamb cladding member 18 and brick mold member 20 can vary.

FIG. 2 particularly illustrates the typical framing of the opening in the walls of a home to form the doorway opening 12. The interior perimeter of the opening 12 is framed by one or more wall studs 22, which typically are wooden 2"×4" members.

To form the interior wall of the house, a wallboard 24 or the like is secured, such as by nails or similar fasteners (not illustrated), to interior surfaces 26 of the wall studs 22 and extends to a position proximate the opening 12. To form a rough exterior surface on the house, plywood 28 or the like is secured, such as by nails or similar fasteners (not illustrated), to exterior surfaces 30 of the wall studs 22 and likewise extends to a position proximate the opening 12.

To form the finished exterior surface to the house, clapboards 32 are secured to the exterior surface of the plywood 28. Alternatively, bricks, siding or the like (not illustrated) can be secured to the exterior surface of the plywood 28 to form the finished exterior of the house.

To finish the inside perimeter of the opening 12 and provide a seat for the door 14 or garage door 16, a jamb member 34 is secured to an interior side 36 of one of the wall studs 22. The jamb member 34 typically is cut or routed to form a recess or channel 38 on a side 40 facing the opening 12 which forms a surface 41 which can be utilized as an exterior stop for the door 14 or 16.

Figure 4:
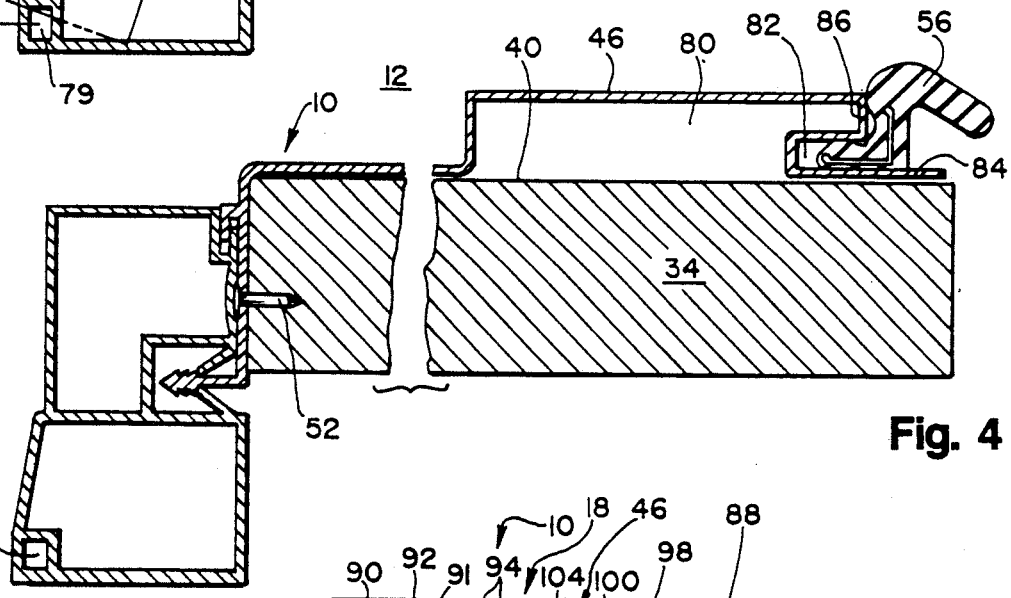
FIG. 4 a horizontal cross-sectional view, similar to FIG. 3, illustrating another embodiment of the assembly of the invention.

Alternatively, as will be described in detail below, the jamb member 34 can be formed without the recess 38 as illustrated in FIG. 4. In this situation, a stop for the door 14 or 16 typically is provided on the side 40 of the jamb member 34 by a wooden strip or the like (not illustrated.)

As FIGS. 2 and 3 illustrate, the jamb cladding member 18 completely covers the side 40 as well as a side 42 of the jamb member 34. The side surfaces 40 and 42 typically are exposed to the environment and consequently are protected by the jamb cladding member 18.

As FIG. 3 illustrates, the jamb cladding member 18 preferably includes first, second, third and fourth leg members 44, 46, 48 and 49 where the first and third legs 44 and 48 are formed at substantially right angles with respect to the second leg member 46 and extend in the same general direction away from the second leg member 46. The fourth leg 49 in turn is formed substantially normal to the third leg 48.

The first leg 44 thus forms a first end 50 of the jamb cladding member 18 which can be secured to the side 42 of the jamb member 34, such as with a nail 52 or the like, and extends across the interface between the jamb member 34 and the wall stud 22. Thus, several nails 52 are utilized along the length of the jamb cladding member 18 to secure it to the jamb member 34.

The third leg 48 forms a second end 54 of the jamb cladding member 18 which is shorter than the first leg 44 and extends across the surface 41 formed by the recess 38. Preferably, the surface 41 of the recess 38 is provided with a saw kerf 58 into which the fourth leg 49 and a first end 60 of the weather strip 56 is inserted to secure the weather strip 56 and the third and fourth legs 48 and 49 to the jamb member 34. The weather strip 56 can be force fit within the saw kerf 58 and can include nails or the like (not illustrated) to assist in securing the weather strip 56 to the jamb member 34.

It is to be noted that, as FIG. 2 illustrates, a second end 62 of the weather strip 56 engages the door 14 or 16 to provide the desired seal therebetween and prevent the elements from entering the house. Furthermore, since the assembly 10 can be secured to both sides and the top of the opening 12, the entire opening 12 is weather stripped. This is particularly important when the assembly 10 is utilized with the garage door 16 where the sides and top of the opening 12 typically are not weather stripped at all.

As described above, the opening 12 typically is framed to provide a finished decorative appearance and to provide an aesthetically pleasing transition between the jamb member 34 and the exterior clapboards 32. Usually, in order to provide such a finished opening 12, either the jamb member 34 is cut or routed in a decorative fashion or one or more wooden molding strips are connected to the jamb member 34 in a desired configuration. This practice requires a significant amount of labor which typically is performed by a carpenter on site, thereby adding to construction time and costs, and cannot readily be accomplished after construction by a carpenter, let alone an unskilled homeowner.

Thus, the brick mold member 20 of the invention is designed to overcome the disadvantages of the above described framing practice by providing a finished decorative molding which readily can be connected to the jamb cladding member 18 to provide the desired decorative appearance and transition to the opening 12. It is to be understood that the particular cross-sectional shape of the brick mold member 20 can vary to provide a variety of shapes as desired.

As FIG. 3 illustrates, the brick mold member 20 is connected to the first end 50 of the jamb cladding member 18 by first and second connecting members 64 and 66. Preferably, the brick mold member 20 includes first and second substantially rectangular shaped housing portions 68 and 70 integrally formed therein.

The first housing portion 68 overlies a portion of the first end 50 of the jamb cladding member 18 and conceals the nails 52 from view from the exterior of the house. Additionally, the first housing portion 68 overlies the end of the first leg 44 of the jamb cladding member 18 and, combined with the second housing portion 70, provides the desired decorative transition between the jamb member 34 and the clapboards 32 as well as a discrete edge for alignment of the clapboards 32.

The first connecting member 64 preferably includes a barbed arrow member 72 extending outward from the jamb cladding member 18 for insertion between two tines 74 formed on the first housing portion 68 of the brick mold member 20. In order to assist in securing the brick mold member 20 to the jamb cladding member 18 and provide a secure tight corner between the brick mold member 20 and jamb cladding member 18, the second connecting member 66 is provided. The second connecting member 66 includes an L-shaped hook member 76 integral with and extending from the jamb cladding member 18 which seats within a corresponding recess 78 formed in the first housing portion 68 of the brick mold member 20.

As FIG. 1 illustrates, it typically is desirable to miter the ends of the brick mold member 20 at the corners of the opening 12. In order to provide a secure tight corner. The second housing portion 70 of the brick mold member 20 includes a keyway 79 at its outermost corner. This keyway 79 can accept a corner key 77 (see FIGS. 2 and 3) which can be made of metal or any other material. The ends of the corner key 77 can be force fit within abutting keyways 79 of two intersecting molding members 20 to form the tight secure mitered corner. To assist in further securing the corner key 77 within the keyways 79, the corner keys can be tapered and/or include barbs for engagement with the interior surfaces of the keyways 79. It is to be understood, however, that the particular shape of the corner keys 77 as well as the way in which they are secured within the keyways 79 can vary.

Alternatively, as FIG. 1*a* illustrates, instead of mitering the brick mold 20 to form the corners, the brick mold 20 can be cut with straight lengths where the end of one length slightly overlaps the other length at the corner as illustrated in dotted outline. In this situation, a molded corner piece 79*a* can be placed over the overlapped joint and snap fit over the interface of the molding members 20 in any desirable manner. The corner piece 79*a* can be formed to have a specific ornamental design, a straight diagonal line to simulate a mitered joint, or any other desired configuration.

Briefly, as FIG. 3 illustrates, to assemble the brick mold member 20 to the jamb cladding member 18, the brick mold member 20 first is positioned as shown in dotted outline with the hook 76 initially inserted into the recess 78. Thereafter, the brick mold member 20 is rotated downward with respect to FIG. 3 about the hook 76 so that the tines 74 engage the barbed arrow member 72.

Thus, the first and second connecting members 64 and 66 and fastener 52 are concealed from view from the exterior of the assembly 10 by the brick mold member 20. Additionally, the design of the first and second connecting members 64 and 66 allow for a slight expansion and contraction due to temperature changes to occur between the brick mold member 20 and the jamb cladding member 18 without causing buckling thereof. It is to be noted that the particular type of connecting members 64 and 66 can vary, and only one connecting member can be utilized, without departing from the teachings of the present invention.

As described briefly above, the second end 54 of the jamb cladding member 18 can be connected to the jamb member 34 in a variety of ways, depending on the particular shape of the jamb member 34. Furthermore, the assembly 10 can be utilized without the weather strip member 56.

In the embodiment illustrated in FIG. 3, the jamb member 34 typically is provided by the manufacturer with the kerf 38 to form the stop surface 41 as well as the recess 58. Alternatively, both the recess 38 and saw kerf 58 readily can be cut into the jamb member 34 during construction of the house before installing the jamb member 34 to the wall stud 22. The recess 38 and saw kerf 58 also can be formed in the jamb member 34 after construction either by removing the jamb member 34 from the wall stud 22 for cutting or making the necessary cuts in the jamb member 34 as it is in place against the wall stud 22.

In either event, in the embodiment of FIG. 3, to assemble the jamb cladding member 18 to the jamb member 34, the fourth leg 49 is inserted into the saw kerf 58 and the first, second and third legs 44, 46 and 48 of the jamb cladding member 18 are positioned about the respective sides 40, 42 and 41 of the jamb member 34. Next, the nails 52 are installed along the length of the first leg 44 of the jamb cladding member 18 to secure it to the side 42 of the jamb member 34. The weather strip member 56 then is force fit within the saw kerf 58 trapping the third leg 48 of the jamb cladding member 18 between the weather strip member 56 and the stop surface 41 and the fourth leg 49 within the saw kerf 58. If desired, to assist in securing the weather strip member 56 to the jamb member 34, the weather strip member 56 can be secured to the stop surface 41 by fasteners, such as nails (not illustrated.)

Alternatively, the jamb member 34 can be formed with the recess 38 but not with the saw kerf 58 (not illustrated.) In such a situation the weather strip member 56 can be modified to exclude the first end 60 and nails can be utilized to secure the weather strip 56 and third leg 48 to the jamb member 34.

FIG. 4 illustrates another embodiment of the assembly 10 where common elements are referred to by the same reference numerals. In this embodiment, the assembly 10 is utilized with a planar jamb member 34 which is not cut to include the recess 38 or saw kerf 58. The second leg 46 is modified to include a substantially rectangular cladding housing 80 which extends a predetermined distance away from the side 40 of the jamb member 34 into the interior of the opening 12. The cladding housing 80 is formed to include a recess 82, similar to the saw kerf 58 of the embodiment of FIG. 3, at the end of the cladding housing 80 proximate the interface with the door 14 so that the weather strip member 56 can be force fit within the recess 82 as described above with respect to the saw kerf 58. Additionally, if desired, nails (not illustrated) can be utilized to further secure the weather strip member 56 and an extending portion 84 of the jamb cladding member 18 to the jamb member 34. It also it to be noted that the cladding housing 80 preferably is formed to include a stop surface 86 similar to surface 41 of the recess 38.

Alternatively, if desired, the rectangular cladding housing 80 can be eliminated and the jamb cladding member 18 can be formed only with first and second leg members 44 and 46 (not illustrated.) In this situation, the end of the second leg member 46 proximate the interface with the door 14 includes the weather strip member 56 which is secured to the jamb member 34 by nails trapping the end of the second leg 46 between the weather strip member 56 and the jamb member 34.

Figure 5:
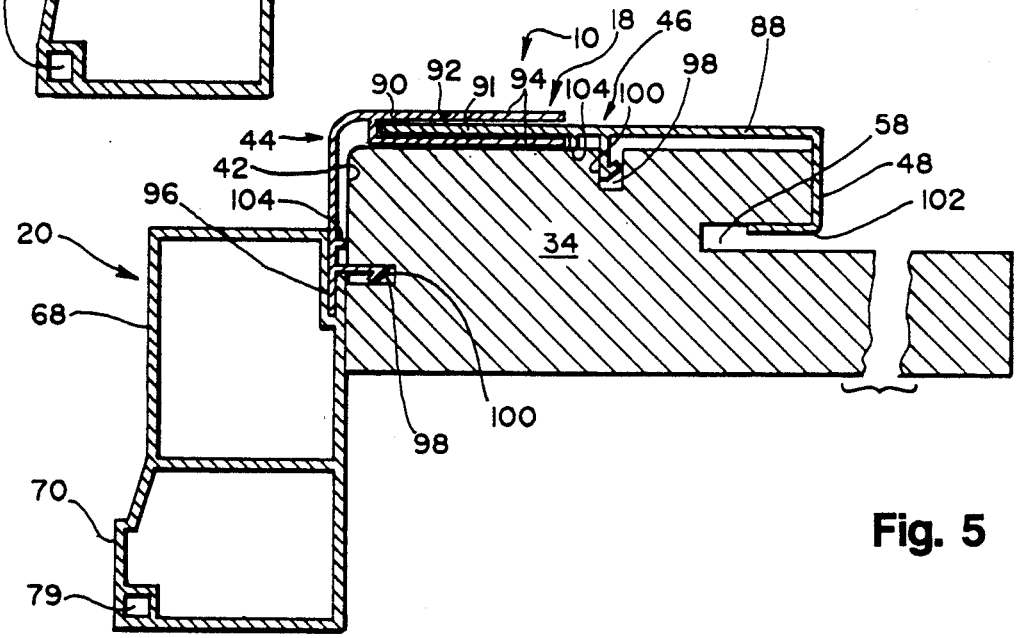
FIG. 5 is a horizontal cross-sectional view, similar to FIGS. 3 and 4, illustrating another embodiment of the assembly of the invention.

FIG. 5 illustrates another embodiment of the assembly 10 where common elements are referred to by the same reference numerals. In this embodiment, the jamb cladding member 18 is formed to be adjustable in order to accommodate jamb members 34 of different cross-sectional dimensions. Specifically, the second leg member 46 now is divided into first and second sections 88 and 90. A first end 91 of the first section 88 is inserted and slidable within a recess 92 formed by a pair of parallel arms 94 on a first end of the second section 90. Thus, the second leg 46 can be shortened or lengthened to accommodate jamb members 34 of different cross-sectional lengths.

Similarly, the first leg member 44 of the jamb cladding member 18 also can be formed without the barbed arrow 72 to be relatively planar. The first housing portion 68 of the brick mold member 20 in turn is formed with a recess 96 where a second end of the second section 90, which forms the first leg 44 can be inserted and is slidable within the recess 96 to as desired distance. Thus, the first leg 44 can be shortened or lengthened to accommodate jamb members 34 of different cross-sectional widths In either event, in order to connect the assembly 10 to the jamb member 34, each of the sides 40 and 42 of the jamb member 34 can be cut to include one or more additional kerfs 98 which can accept a protruding barb 100. Furthermore, to assist in connecting the jamb cladding member 18 to the jamb member 34, if the jamb member 34 is cut to include both the kerf 38 and saw kerf 58, the third leg 48 can include an additional fourth leg 102, similar to the fourth leg 49 of the embodiment of FIG. 3, extending substantially normal therefrom for seating within the saw kerf 58. As in the previous embodiments, the weather strip 56 also can be applied if desired.

It is to be noted that in the embodiment of FIG. 5 the first and second connecting members 64 and 66 of the previous embodiments typically are not employed. The brick mold member 20 is connected to the side 42 of the jamb member 34 by a barb 100 forced into a corresponding kerf 98 formed in the jamb member 34 and is connected to the jamb cladding member 18 through the seating of the first leg 44 within the recess 96 of the brick mold member 20. To provide proper spacing between the jamb cladding member 18 and the jamb member 34 and to provide proper seating within the recesses 96 and 92, spacers 104 extending outwardly from the jamb cladding member 18 can be utilized. Furthermore, the barbs 100, kerfs 98, fourth leg 102 and spacers 104 can be utilized in any of the embodiments of FIGS. 3 and 4 without departing from the teachings of the present invention.

Modifications and variations of the present invention are possible in light of the above teachings. It is therefore to be understood that within the scope of the appended claims, the invention may be practiced otherwise than as specifically described.

I claim:

1. A jamb cladding and brick mold assembly for enclosing the exterior surfaces of a jamb surrounding an opening in a building such as a door, garage door or window and providing a maintenance free protective cover for the jamb as well as a decorative molding between the jamb and an exterior surface of a building, the assembly comprising:

a jamb cladding member for enclosing the exposed exterior surfaces of the jamb, said cladding member having a first end connected to said jamb;

a brick mold member positioned overlying the interface between the jamb and the exterior surface of the building; and first means for connecting said brick mold member to said first end of said cladding member so that said brick mold member overlies and conceals said first means for connecting and the interface between said cladding member and said brick mold member from the exterior thereof.

2. The assembly as defined in claim 1 including a fastener for connecting said first end of said cladding member to said jamb, said brick mold member overlying and concealing said fastener from the exterior thereof.

3. The assembly as defined in claim 1 including weather strip means connected to said jamb cladding member for engagement with the door or window.

4. The assembly as defined in claim 1 including second means for connecting said brick mold member to said first end of said cladding member, said second means for connecting being concealed from the exterior of the assembly by said brick mold member.

5. The assembly as defined in claim 4 wherein said first and second means for connecting allow said brick mold member to expand and contract with respect to said jamb cladding member.

6. The assembly as defined in claim 5 wherein said first means for connecting include a barbed ratchet arrow extending from said first end of said jamb cladding member for locking engagement with said brick mold member.

7. The assembly as defined in claim 6 wherein said second means for connecting include a substantially L-shaped hook member extending outward from said first end of said jamb cladding member for seating within a corresponding recess formed in said brick mold member.

8. The assembly as defined in claim 1 wherein said brick mold member includes means for connecting a first brick mold member to a second brick mold member at mitered ends of said first and second brick mold members to form a tight, finished mitered corner to the opening in the building.

9. The assembly as defined in claim 1 wherein said brick mold member includes cover plate means for concealing a corner joint between first and second brick mold members, said cover plate means being connected to at least one of said first and second brick mold members.

10. A jamb cladding and brick mold assembly for enclosing the exterior surfaces of a jamb surrounding an opening in a building such as a door, garage door or window and providing a maintenance free protective cover for the jamb as well as a decorative molding between the jamb and an exterior surface of a building, the assembly comprising:

a jamb cladding member for enclosing the exposed exterior surfaces of the jamb, said cladding member having a first end connected to said jamb by a fastener and a second end extending around a stop formed in the jamb and connected thereto;

a brick mold member positioned overlying the interface between the jamb and the exterior surface of the building; and first means for connecting said brick mold member to said first end of said cladding member so that said brick mold member overlies and conceals said first means for connecting, said fastener and the interface between said cladding member and said brick mold member from the exterior thereof.

11. The assembly as defined in claim 10 including weather strip means connected to said jamb cladding member for engagement with the door or window.

12. The assembly as defined in claim 10 including second means for connecting said brick mold member to said first end of said cladding member, said second means for connecting being concealed from the exterior of the assembly by said brick mold member.

13. The assembly as defined in claim 12 wherein said first and second means for connecting allow said brick mold member to expand and contract with respect to said jamb cladding member.

14. The assembly as defined in claim 13 wherein said first means for connecting include a barbed ratchet arrow extending from said first end of said jamb cladding member for locking engagement with said brick mold member.

15. The assembly as defined in claim 14 wherein said second means for connecting include a substantially L-shaped hook member extending outward from said first end of said jamb cladding member for seating within a corresponding recess formed in said brick mold member.

16. A jamb cladding and brick mold assembly for enclosing the exterior surfaces of a jamb surrounding an opening in a building such as a door, garage door or window and providing a maintenance free protective cover for the jamb as well as a decorative molding between the jamb and an exterior surface of a building, the assembly comprising:

a jamb cladding member for enclosing the exposed exterior surfaces of the jamb, said cladding member having a first end connected to said jamb by a fastener and a second end formed to provide a stop;

a brick mold member positioned overlying the interface between the jamb and the exterior surface of the building; and first means for connecting said brick mold member to said first end of said cladding member so that said brick mold member overlies and conceals said first means for connecting and the interface between said cladding member and said brick mold member from the exterior thereof.

17. The assembly as defined in claim 16 wherein said second end of said cladding member includes a recess for accepting a weather strip member therein.

18. The assembly as defined in claim 16 including weather strip means connected to said jamb cladding member for engagement with the door or window.

19. The assembly as defined in claim 16 including second means for connecting said brick mold member to said first end of said cladding member, said second means for connecting being concealed from the exterior of the assembly by said brick mold member.

20. The assembly as defined in claim 19 wherein said first and second means for connecting allow said brick mold member to expand and contract with respect to said jamb cladding member.

21. The assembly as defined in claim 20 wherein said first means for connecting include a barbed ratchet arrow extending from said first end of said jamb cladding member for locking engagement with said brick mold member.

22. The assembly as defined in claim 21 wherein said second means for connecting include a substantially L-shaped hook member extending outward from said first end of said jamb cladding member for seating within a corresponding recess formed in said brick mold member.

23. An adjustable jamb cladding and brick mold assembly for enclosing the exterior surfaces of a jamb surrounding an opening in a building such as a door, garage door or window and providing a maintenance free protective cover for the jamb as well as a decorative molding between the jamb and an exterior surface of a building, the assembly comprising:

a jamb cladding member for enclosing the exposed exterior surfaces of the jamb, said cladding member having first and second sections, a first end of said first section being received within a channel formed in a first end of said second section for sliding, adjustable engagement therein, said first section being connected to said jamb member; and a brick mold member positioned overlying the interface between the jamb and the exterior surface of the building, said brick mold member including means for connecting said brick mold member to said jamb and a recess therein for receiving a second end of said second cladding section for sliding, adjustable engagement therein so that said second cladding section can be adjustable with respect to said first cladding section and said brick mold member to enable said jamb cladding member to accommodate jamb members of varying cross-sectional dimensions.

24. A jamb cladding and brick mold assembly for enclosing the exterior surfaces of a jamb surrounding an opening in a building such as a door, garage door or window and providing a maintenance free protective cover for the jamb as well as a decorative molding between the jamb and an exterior surface of a building, the assembly comprising:

a jamb cladding member for enclosing the exposed exterior surfaces of the jamb, said cladding member having a first end connected to said jamb by a fastener and a second end extending around a stop formed in the jamb and connected thereto;

a brick mold member positioned overlying the interface between the jamb and the exterior surface of the building;

first means for connecting said brick mold member to said first end of said cladding member so that said brick mold member overlies and conceals said first means for connecting, said fastener and the interface between said cladding member and said brick mold member from the exterior thereof; and a weather strip member connected to said jamb proximate said stop and trapping said second end of said jamb cladding member between a portion of said weather strip member and said stop.

25. The assembly as defined in claim 24 wherein said jamb further includes a saw kerf proximate said stop and said weather strip member includes a first portion for engagement within said saw kerf and a second portion for trapping said second end of said jamb cladding member between said second portion of said weather strip member and said stop.

* * * * *